United States Patent [19]

Yamasaki

[11] Patent Number: 5,038,757

[45] Date of Patent: Aug. 13, 1991

[54] EXTENDIBLE AND CONTRACTIBLE BED-TYPE MASSAGE DEVICE

[75] Inventor: Yoshikiyo Yamasaki, Osaka, Japan

[73] Assignees: Kabushiki Kaisha Fuji Iryoki; Kabushiki Kaisha Japan Health, both of Osaka, Japan

[21] Appl. No.: 407,963

[22] Filed: Sep. 15, 1989

Related U.S. Application Data

[63] Continuation-in-part of Ser. No. 319,219, Mar. 3, 1989, Pat. No. 4,899,403.

[51] Int. Cl.[5] ..... A61H 7/00; A61H 1/00

[52] U.S. Cl. ..... 128/52; 128/33; 128/57; 128/60

[58] Field of Search ..... 128/33, 44, 51, 52, 128/55, 57, 60, 61; 74/424.8 R

[56] References Cited

U.S. PATENT DOCUMENTS

| | | | |
|---|---|---|---|
| 1,576,266 | 3/1926 | Biggert, Jr. | 74/424.8 R |
| 1,645,339 | 10/1927 | Monroe | 128/57 |
| 2,204,624 | 6/1940 | Rupp | 128/33 X |
| 3,446,205 | 5/1969 | Minohara | 128/57 |
| 3,759,250 | 9/1973 | Salata | 128/57 |
| 3,943,844 | 3/1976 | Standbridge | 74/424.8 R X |
| 4,010,714 | 3/1977 | Notsuki et al. | 119/14.03 |
| 4,373,516 | 2/1983 | Masuda et al. | 128/57 |
| 4,412,534 | 11/1983 | Hamabe et al. | 128/52 |
| 4,656,998 | 4/1987 | Masuda et al. | 128/57 |
| 4,662,362 | 5/1987 | Masuda et al. | 128/33 |
| 4,718,408 | 1/1988 | Barreiro | 128/52 |
| 4,899,403 | 2/1990 | Yamasaki | 5/60 |
| 4,947,833 | 8/1990 | Yamasaki | 128/52 |

FOREIGN PATENT DOCUMENTS

| | | | |
|---|---|---|---|
| 2949366 | 5/1981 | Fed. Rep. of Germany | 128/52 |
| 3026941 | 2/1982 | Fed. Rep. of Germany | 128/52 |

*Primary Examiner*—Edgar S. Burr
*Assistant Examiner*—Eric P. Raciti
*Attorney, Agent, or Firm*—Flynn, Thiel, Boutell & Tanis

[57] ABSTRACT

A bed base having first and second members which are of generally U-shaped configuration so as to slidably telescope together to permit expansion or contraction of the bed base in the lengthwise direction. Locking mechanism coacts between the telescoping legs to lock the bed base in the selected expanded or contracted position. A sheet-like cover is anchored at one end of the bed base and extends over the upper surface thereof toward the other end, at which point an intermediate part of the cover wraps downwardly around a guide drum. The lower free end of the cover is connected to a compensating mechanism which adjusts cover length. A drive mechanism is mounted adjacent one end of the bed base and includes elongate drive screws which extend along the legs of one base member. A roller massaging unit is positioned beneath the cover and extends transversely between the legs and is coupled to the drive screw so as to be movable in the lengthwise direction of the bed base. Limit switches provided on the base members adjustably control cyclic back-and-forth movement of the massage unit in correspondence to the adjusted length of the bed base.

7 Claims, 4 Drawing Sheets

EXTENDIBLE AND CONTRACTIBLE BED-TYPE MASSAGE DEVICE

CROSS REFERENCE TO RELATED APPLICATION

This application is a continuation-in-part of my copending application Ser. No. 07/319 219 filed Mar. 3, 1989.

FIELD OF THE INVENTION

The present invention relates to a bed-type massage device so devised that it can perform a full body massage of a person in a position lying face upwards. More particularly, the invention relates to a bed-type massage device that is constituted by a bed base which is telescopable, whose extension can be finely adjusted and which permits repeated advance and return movement of massaging rollers provided on this bed base.

BACKGROUND OF THE INVENTION

Bed-type massage devices are generally provided with massaging rollers which can be displaced by a drive device in a bed base and are so constructed that the massaging rollers travel on guide rails provided on both sides inside the bed base, the arrangement being such that when a user lies face upwards on the bed-type massage unit the massaging rollers roll along his or her dorsal region and effect finger-pressure type massage thereof.

In recent years there has been research on and development of units in which such bed-type massage devices are made contractible to as compact a size as possible in order to reduce the space needed at times of transport and delivery or during storage.

For example, as disclosed in Japanese Laid-open Patent Application No. 59-189848 and Japanese Laid-open Utility Model Application No. 61-54834, there are known bed-type massage devices which are designed to reduce space requirements at times of transport and delivery or during storage by being constructed in such a way that foldable guide rails are provided on both sides inside a bed base and the bed frame itself is formed as an elastic body which is foldable and the massaging rollers can run along the guide rail, whereby the base unit can be folded into halves or thirds when it is not in use.

However, the structure in these conventional bed-type massage devices is such that extension and contraction of the bed base is employed solely for the purposes of transport and delivery or storage and, although the size of the bed base can be reduced in the longitudinal direction, it is impossible to reduce the volume and so the devices still fail to resolve problems in packing, etc.

Further, since conventional bed-type massage devices are units designed for the purpose of reduction of size at times of transport and delivery or during storage and are not constructed in a manner permitting adjustment of the extension or contraction in accordance with the height of the user, if a user who is shorter than the length of the bed base uses the base to effect massaging, the massaging rollers move to portions beyond the body of the user, i.e., they move over an unnecessarily large range, which is wasteful both in terms of electric power and of time.

By way of a means for resolving this problem, the present Applicant discovered a means whereby a bed base of a bed-type massage device can be extended or contracted in opposed lengthwise directions without being folded and which permits fine adjustment of the extension in accordance with the height of the user. In this case, however, although extension and contraction in opposed lengthwise directions and fine adjustment of the extension are possible, there are problems associated with aspects such as the means for disposing the massaging rollers inside the bed base to match the bed base in different states and the drive means for causing the massaging rollers inside the bed base to move forward and back in a manner such as to match the bed base in different states.

It is the object of the present invention to resolve the various problems noted above and provide a bed-type massage device in which a massage unit is not driven when the bed base is contracted but the massage unit can longitudinally travel repeatedly and smoothly over the whole area of the bed base when the bed base has been extended or contracted and fine adjustment of the extension has been made.

It is a characteristic of the bed-type massage device of the invention that it comprises a variable bed base which is made freely extendible and contractible in opposed lengthwise directions and in which a first side of a flat second base fits into an opening on one side of a flat first base, at least one retention hole is formed on the left and on the right in the lower surface of the second base, and lock pins which are engageable in these retention holes are so provided that lock mechanisms provided at the tips thereof face the second base from the left and right of the other side of the first base; a pair of guide rails which are laid lying along the longitudinal direction on the left and right of the upper surface of at least the first base of the said bed base; a drive mechanism in which a drive motor is provided at and orthogonal to one end of the second base in the longitudinal direction, worms are respectively coupled with the ends of two drive shafts of this drive motor and the respective ends of a pair of rod-like screwshafts which are respectively provided along both lengthwise sides of the second base are in screw engagement which the respective worms; a massaging unit which is constituted by effecting screw engagement of both sides of the base end of a frame unit with the pair of rod-like screwshafts of the said drive mechanism providing facing running rollers which are capable of moving and running over the said guide rail on both sides of the lower part of the far end of the said frame unit and providing rolling members at a set interval above the base end and the far end of the said frame unit; and a covering cloth that is wound around to cover the entire upper surface of the bed base, and the device is so constructed that the massage unit can repeatedly travel over the bed base and the variable bed base is freely extendible and contractible to permit adjustment to any required length.

Having the above construction, the bed-type massage device of the invention brings about the following effects.

All that is needed if it is wished to adjust the length of the bed-type massage device of the invention to match the height of a user is to push the first base of the variable bed base in the direction of the second base and lock it in the said position by means of the lock mechanisms, and if it is required to shorten the bed at times such as when the bed is packed for transport or is delivered it can easily be reduced to about half its length by releasing the lock mechanisms and pushing in the first base into which the second base is inserted.

Further, when it is wished to extend the bed base after it has been shortened, this can easily be done by simply releasing the lock mechanisms, pulling the first base so that the second base is moved out from it and then, after the bed has been set to the required length, locking it with the lock mechanisms.

When the adjustment of the length of the bed-type massage device has been completed, the user lies face upwards on its variable bed base and then simply actuating the drive motor brings about an agreeable massaging action in which, through the action of the drive mechanism, the massage unit is caused to move and travel on the guide rails, limit switches at the variable bed base's terminal and start ends in the longitudinal direction are actuated and cause repeated displacement and travel of the said massage unit, so causing rotatable rollers of the rolling members to slide while coming into uniform contact with the whole surface of the user's back.

The bed-type massage device of the invention will now be described in detail with reference to one embodiment thereof which is shown in the drawings.

DETAILED DESCRIPTION

Figure 1:
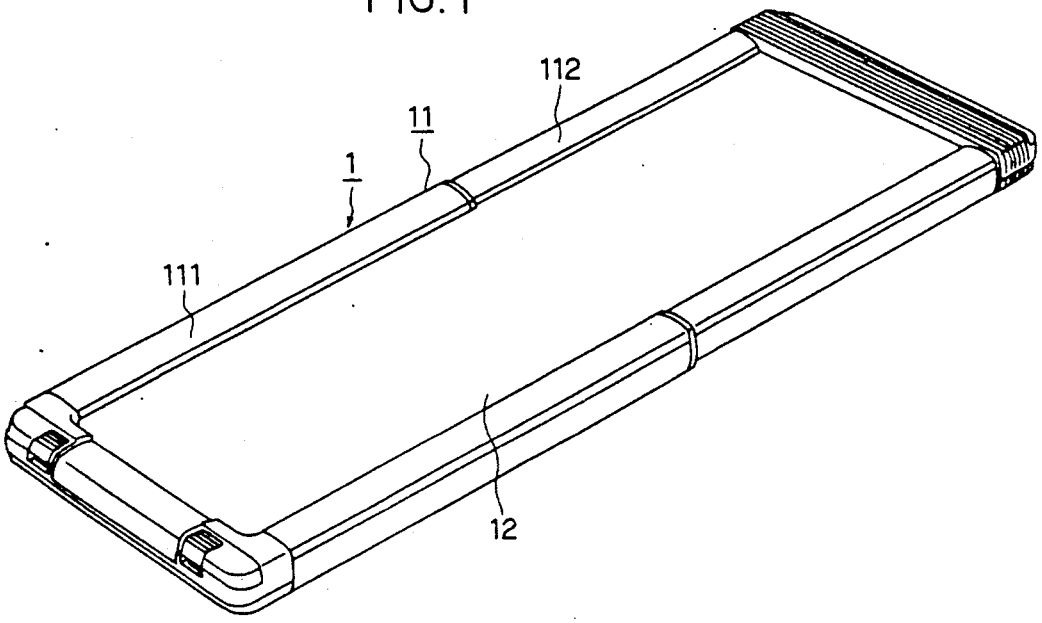
FIG. 1 is a perspective view showing one embodiment of the bed-type massage device of the invention.
Figure 2:
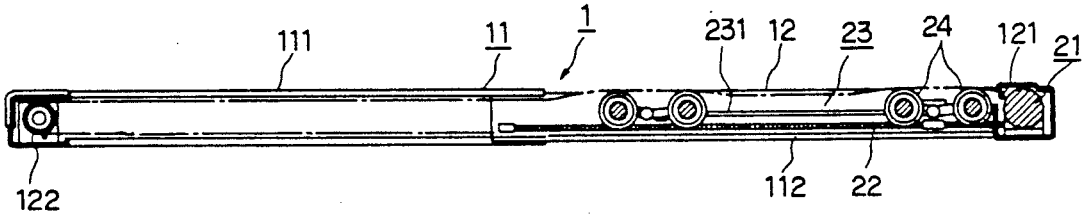
FIG. 2 is a longitudinal sectional view of the embodiment of FIG. 1.
Figure 3:
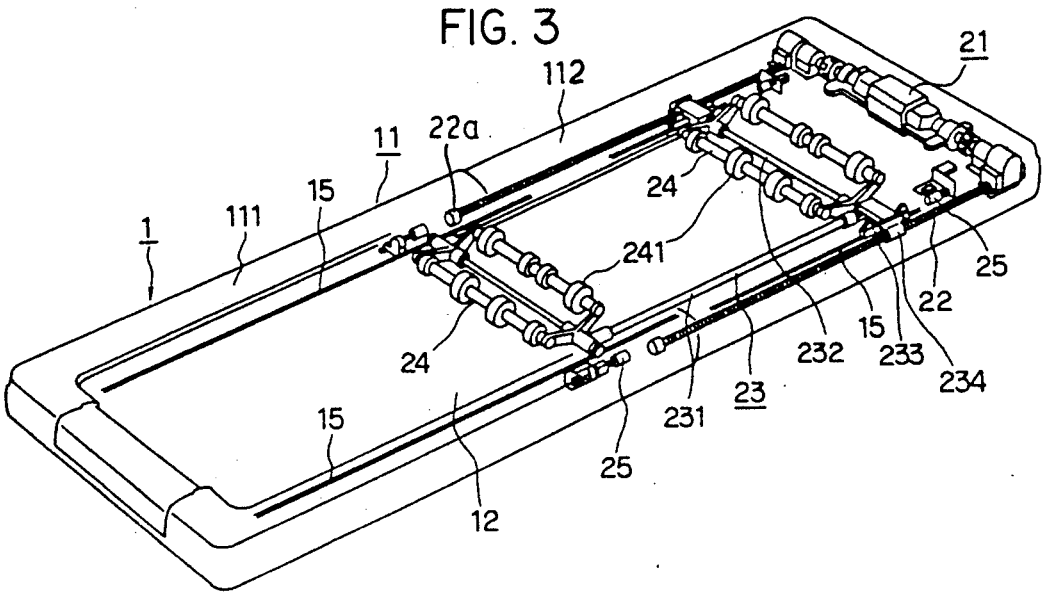
FIG. 3 is an explanatory drawing showing the bed-type massage device with the cover cloth removed.

FIGS. 1 to 3 show one embodiment of a bed-type massage device according to the invention. This bed-type massage device 1 is extendible and contractible in opposed lengthwise directions and is constituted by a variable-length bed base arrangement 11 provided with lock mechanisms 14 which can effect locking in extended or contracted positions, a pair of guide rails 15 which are laid lengthwise of the upper surface of the right and left legs of at least one U-shaped base (the first base) 111 of the base arrangement 11, a drive mechanism 21 for effecting synchronous rotation of a pair of rod-like screwshafts 22 that are respectively provided along both lengthwise legs or sides of another U-shaped base (the second base) 112, a movable massage unit 23 which extends across and is in screw engagement with the two rod-like screwshafts 22 and can move and travel on the guide rails 15, limit switches 25 which are provided on one side of the above-noted bases 111 and 112 so as to bring about reversal and repeated reciprocal displacement of the massage unit 23, and a covering cloth 12 which is wound in a manner such that it covers the entire upper surface of the variable bed base arrangement 11. The construction is such that the massage unit 23 can repeatedly travel back-and-forth on the base arrangement 11 and the base arrangement 11 is extendible and contractible to permit adjustment to any length.

In more detail, as shown in FIGS. 1 and 2, the bed base arrangement 11 is constituted by the first U-shaped base 111, which is flat and has a length which is about half that of the base arrangement 11, and the second U-shaped base 112, which is the same shape and has approximately the same length as the first base 111 so that the legs of base 112 slidably telescope into the legs of base 111, whereby the bed base arrangement 11 can be lengthwise extended or shortened to any length (but the minimum shortened length being about half the maximum extended length of the base arrangement 11). The legs of bases 111 and 112 are of generally U-shaped cross section so as to be telescopically slidable one within the other, which U-shaped sections open inwardly toward one another.

The adjustable bed base arrangement 11 is provided with lock mechanisms 14 which can effect locking in positions of extension or contraction between the bases 111 and 112.

Figure 5:
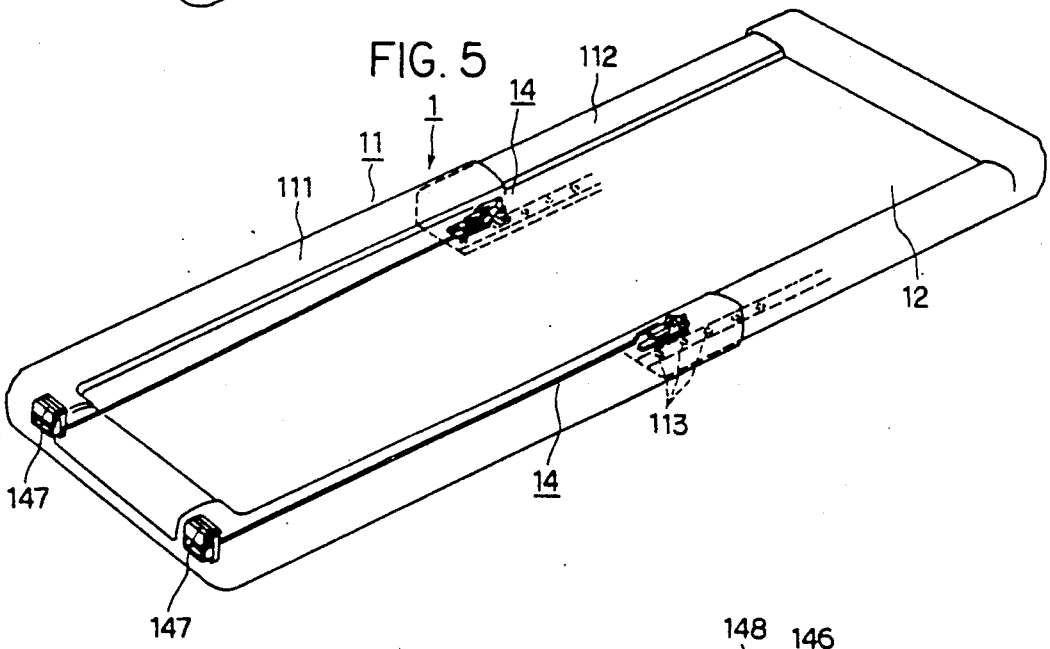
FIG. 5 is an explanatory drawing showing one embodiment of a lock mechanism in the bed-type massage device of the invention.
Figure 6:
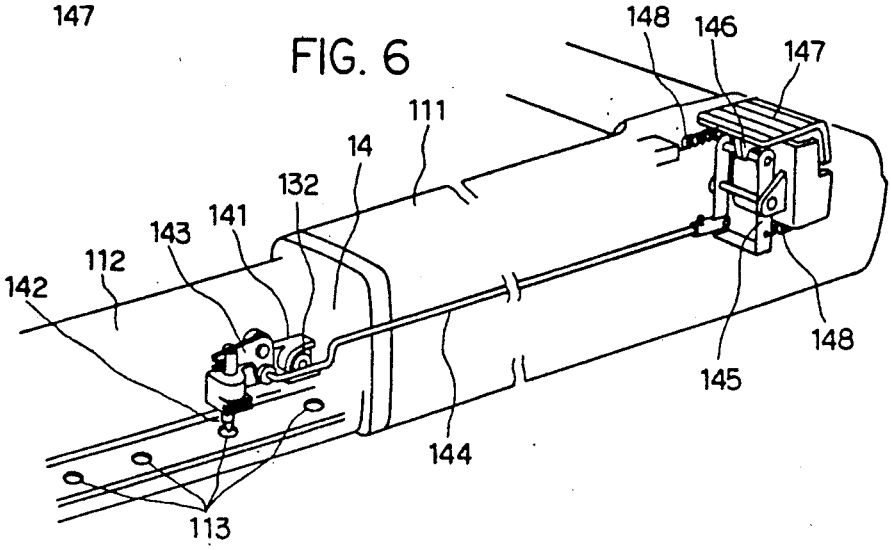
FIG. 6 is an enlarged explanatory drawing showing the lock mechanism.

As shown in FIGS. 5 and 6, the lock mechanisms 14 are constituted by a plurality of retention holes 113 formed at set lengthwise intervals in the bottom walls of both legs of the base 112, lock pins 142 which are engageable with these lock holes, support elements 141 which support the lock pins 142 in a manner permitting them to project out or be retracted, depression elements 143 with an L-shaped profile which are pivotally mounted on the support elements 141 and each have one end pivotally connected to the head portion of the lock pin 142 and by which the lock pins 142 are depressibly supported, push-pull rods 144 which have their far ends connected to the other ends of the depression elements 143 and guide the depression elements, tilt frame members 145 whose lower portions are connected to the base ends of the push-pull rods 144 and which have pivotal mounting portions in their centers so as to permit pushing and pulling of the push-pull rods 144, and push-pull plates 146 fixed to the ends of grip elements 147 which are provided on the first base 111 to permit holding of the upper portions of the tilt frame members 145 in a manner permitting them to be pushed or pulled.

The tilt frame members 145 and push-pull plates 146 have a construction in which they are urged to return to their original positions by springs 148.

As shown in FIG. 3, the guide rails 15 are laid lengthwise on the upper surfaces of the bottom walls of the legs of the bases 111 and 112.

Figure 11:
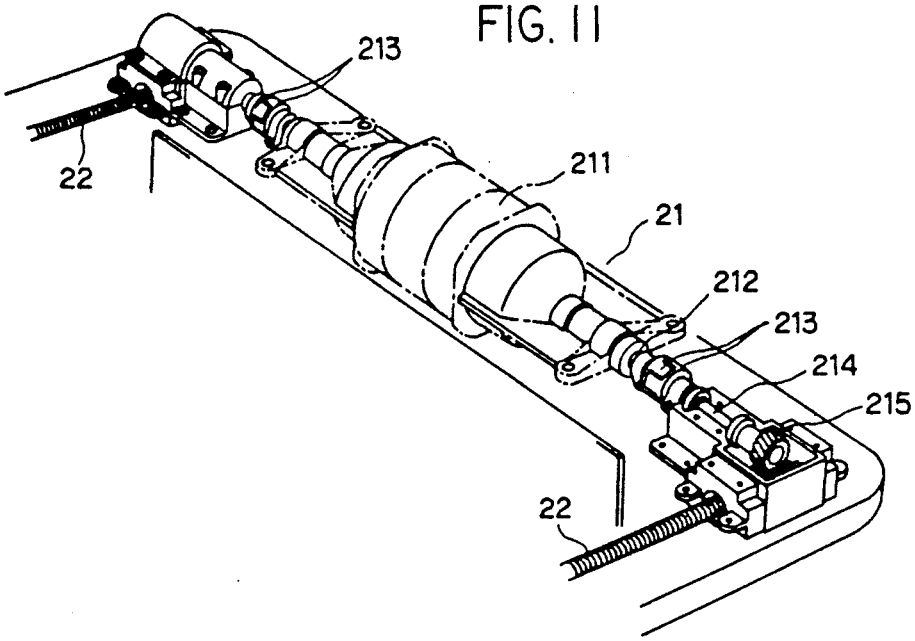
FIG. 11 is an explanatory drawing showing the extended state of the bed-type massage device.

As shown in FIG. 3 and FIG. 11, the above-noted drive mechanism 21 includes a drive motor 211 which is provided at one end of the second base 112 and orthogonal to the longitudinal direction, drive shafts 214 which are connected via couplings 213 on the lines of extension of two motor shafts 212 of the drive motor 211, synchronously rotatable worm gears 215 which are connected to the ends of respective drive shafts 214, and the pair of rod-like screwshafts 22 which are respectively provided in the longitudinal direction interiorly along both legs of the second base 112, and each have one end in mesh with the respective worm gear 215 whereby the screwshafts are actuated cooperatively with the worm gears, the drive mechanism 21 thus being so arranged that in response to actuation of the drive motor 211, rotation of the two motor shafts 212 is transmitted via the couplings 213 and drive shafts 214 to the respective worm gears 215, thereby causing rotation of the rod-like screwshafts 22. The free ends of screws 22 are supported by bearings **22*a* mounted adjacent the free ends of the legs of base 112**.

Figure 12:
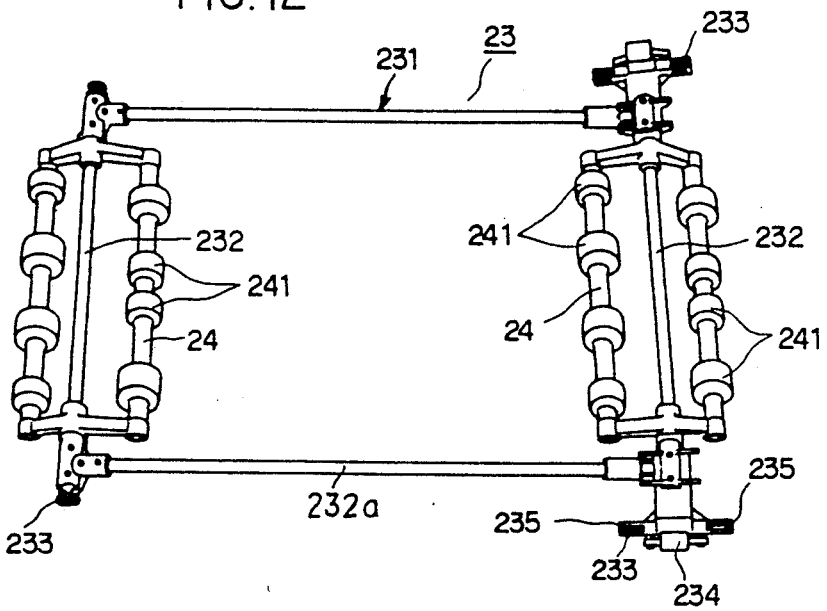
FIG. 12 is an explanatory drawing showing one embodiment of a massage unit of the bed-type massage device.

As shown in FIG. 3 and FIG. 12, the massage unit 23 is a unit in which parallel support shafts 232 are rigidly joined by parallel side rails **232*a* to form a frame unit 231 formed in the shape of a rectangular ring-like frame, rolling elements 24 provided with a plurality rotatable rollers 241 are shaft-mounted on respective support shafts 232, travelling rollers 233 which can travel on the above-noted guide rails 15 are mounted on both ends of each support shaft 232 and holder tubes 234 having internally formed female threads that mesh with the respective rod-like screwshafts 22 are fixed on both sides of the frame unit 231; the unit thus being so devised that by mounting the massage unit 23 in a bridge-over manner such that the two rod-like screwshafts 22 are in meshing engagement with the respective holder tubes 234, the massage unit 23 can be moved and caused to travel along the guide rails 15**.

The above-noted limit switches 25 are provided at the displacement end and start points of the massage unit 23 as shown in FIG. 3 and serve to cause repeated reciprocal displacement and travel of the massage unit 23. The limit switches 25 are shown respectively provided at one side of the one end in the longitudinal direction of the second base 112 and on one side near the longitudinal opening of the first base 111 in the drawing, and the arrangement is such that when a support shaft projection 234 of the massage unit 23 contacts a limit switch 25, the direction of rotation of the motor shafts 212 of the drive motor 211 and hence the direction of rotation of the rod-like screwshafts 22 is reversed, thereby causing reversal of the direction of movement of the massage unit 23.

Figure 4:
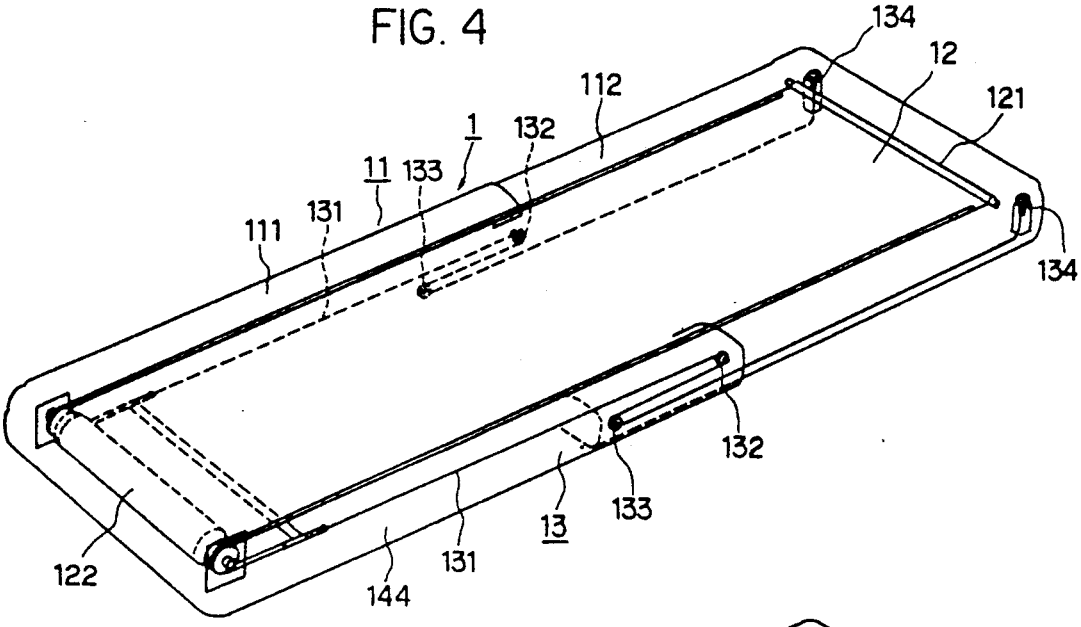
FIG. 4 is an explanatory drawing showing one embodiment of a covering cloth adjustment mechanism.

The above-noted covering cloth 12 is wound on in a manner such that it responds to the degree of extension of the variable bed base arrangement 11 and always covers its upper surface. As shown in FIG. 4, in order to maintain such a wound state, a fixed bar 121 is provided extending across the other end of the second base 112, one end of the covering cloth 12 is fixed to this fixed bar 121, a rotary drum 122 is rotatably installed extending across the other end of the first base 111, and the other end of the covering cloth 12 is passed via this rotary drum 122 and pulled by a covering cloth spread adjustment mechanism 13, thereby permitting constant adjustment and maintenance of the covering cloth 12 in a stretched state.

Figure 7:
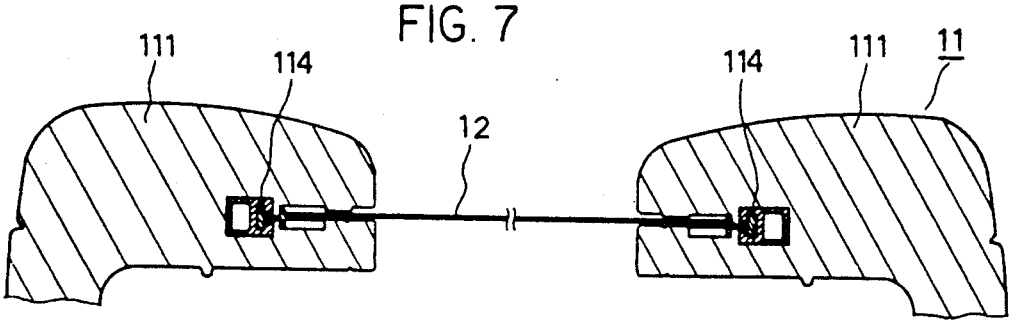
FIG. 7 is an explanatory drawing illustrating stretching of the covering cloth in the bed-type massage device of the invention.

In order to effect smooth cooperative movement with the rotary drum 122 when the spread of the covering cloth 12 is increased or reduced, guide grooves 114 (FIG. 7) are provided in the inner surfaces of both sides of the bed base arrangement 11 and the two side edges of the covering cloth 12 are slidingly supported in these guide grooves 114.

Figure 8:
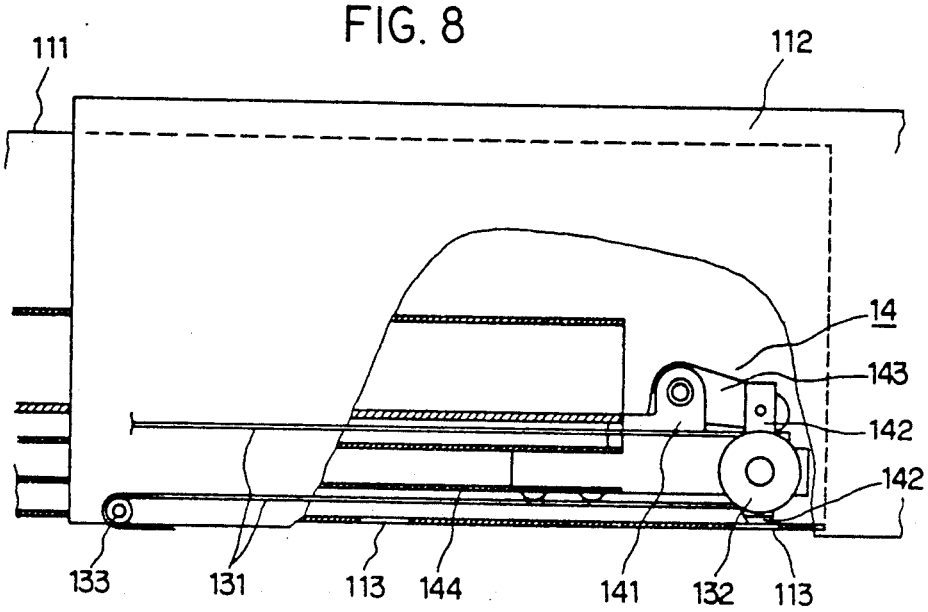
FIG. 8 is a partial explanatory drawing showing a covering cloth spread adjustment mechanism and a lock mechanism in the bed-type massage device of the invention.

As noted above, the covering cloth spread adjustment mechanism 13 is a means for making adjustments such that regardless of the degree of extension of the bed base arrangement 11, the covering cloth 12 always covers the top surface of the bed base arrangement 11 while in a stretched state. As shown in FIG. 4 and FIG. 8, this covering cloth spread adjustment mechanism 13 includes wires 131 which are respectively connected at opposite sides to the other end of the covering cloth 12, first rotatable rollers 132 provided on the legs of the first base 111 adjacent the free ends thereof, second rotatable rollers 133 provided on the legs of the second base 112 adjacent the free ends thereof, and wire fixing elements 134 by which the other ends of respective wires 131 are fixed adjacent the ends of the bight of the second base 112. The arrangement is such that each wire 131 connected to the end of the covering cloth 12 is engaged on the first rotatable roller 132, is reversed in direction, then is engaged on the second rotatable roller 133 and is reversed in direction again with the other end of each wire 131 fixed to a wire fixing element 134, thus making it possible to make adjustments in response to the degree of extension of the bed base arrangement 11 and make the covering cloth 12 cover the whole of the upper surface of the bed base arrangement 11 while keeping the covering cloth 12 stretched.

The first rotatable rollers 132 may be mounted directly on the support elements 141 of the lock mechanisms 14 as illustrated in FIG. 6. This achieves the greatest possible compactness of construction, although one may suitably decide on the manner of their mounting.

OPERATION

Figure 13:
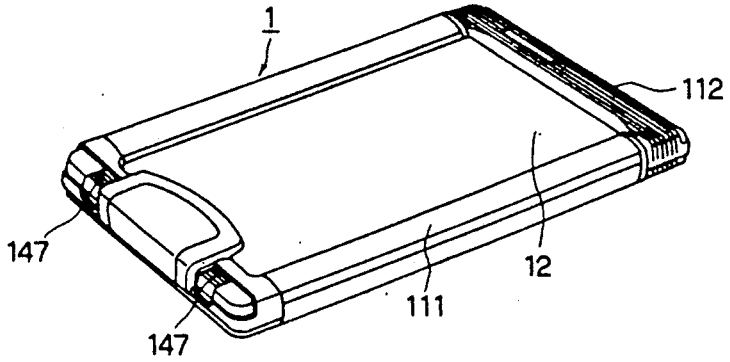
FIG. 13 is a perspective view showing the contracted state of the bed-type massage device.

Since the bed-type massage device of the invention is constructed in the manner indicated above, one may make use of this and when it is desired to shorten the bed as at times of packing for transportation and delivery, the bed can easily be shortened to about half its length as shown in FIG. 13 simply by releasing the lock mechanisms 14 and pushing the first base 111 so that the second base 112 is inserted into it.

When it is desired to extend the base arrangement 11 after it has been shortened, it can be easily extended to a state such as shown in FIG. 1 simply by releasing the lock mechanisms 14 as described above, pulling the first base 111 so that the second base 112 moves out of it, and setting the bed length to the required length and then engaging the lock pins 142 of the lock mechanisms 14 in the retention holes 113 at the relevant position.

Figure 9:
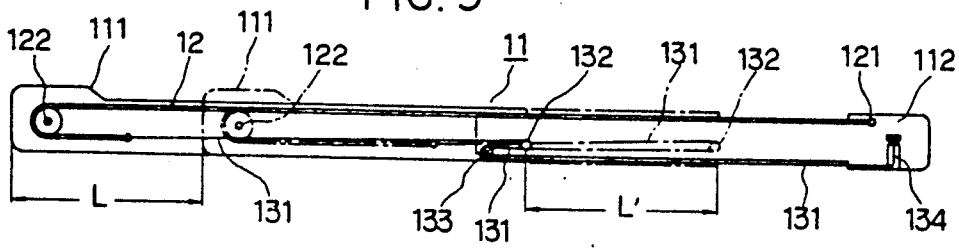
FIG. 9 and FIG. 10 are explanatory elevational drawings of the bed-type massage device.

As illustrated in FIG. 9 on lengthening or shortening the variable bed base arrangement 11, the covering cloth 12 is constantly kept in a stretched state by the covering cloth stretch adjustment mechanism 13. Pushing the first base 111 towards the second base 112, or pulling it away, results in the bed base arrangement 11 being extended or shortened by an amount corresponding to the distance L over which the first base 111 has been moved, and as the wires 131 and the covering cloth 12 are always of constant lengths in such cases, when the above action is performed the first rollers 132 are moved in the same direction as the first base 111 simultaneously with shortening of the base arrangement 11 and a portion of the covering cloth 12 corresponding to the length L' of wires paid out between the rotatable rollers 132 and 133 goes via the rotary drum 122 and is drawn downwards from the upper surface of the bed base arrangement 11, and as a result the covering cloth 12 on the top surface of the base arrangement 11 is shortened by an amount L' which is the same length as the distance L over which the base arrangement 11 is shortened, and so the base arrangement 11 and covering cloth 12 are always extended or shortened in conjunction.

Figure 10:
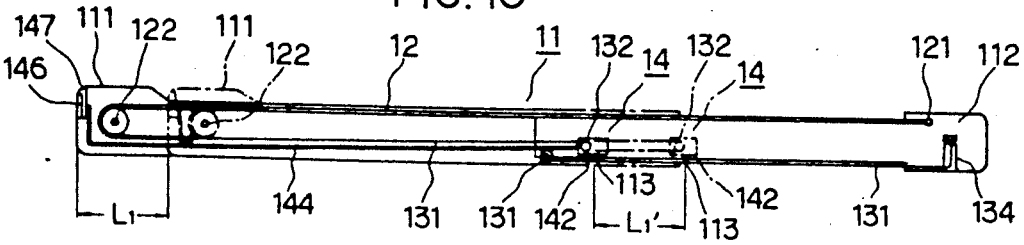

As illustrated in FIG. 10, when it is desired to adjust the bed's length to match the height of a user, the push-pull plates 146 of the grip elements 147 provided on two sides of the bed base arrangement 11 are pulled forward and the lock pins 142 which are actuated via the push-pull rods 144 and depression elements 143 are released from the retention holes 113 and, while they are released, the first base 111 is pushed towards or pulled away from the second base 112 over the required distance (limited to places where there are retention holes 113) so as to lengthen or shorten the bed by the push-in or pull-out distance L1.

On release of the push-pull plates 146 of the grip elements 147 at the required position, the lock pins 142 which are actuated via the push-pull rods 144 and depression elements 143 are engaged in the desired retention holes 113, thus locking the base bed arrangement 11 at that position.

In this case too, the covering cloth 12 action is the same as described above, so resulting in the cloth being shortened by a length L' which is the same as the distance L by which the bed base 11 is shortened (L1=L1').

After completion of adjustment of the length of the bed-type massage device 1 in the manner described above, the user lies face upwards on the bed base arrangement 11 and as a result of simple actuation of the drive motor 211 the massage unit 23 is moved and caused to travel along the guide rails 15 by the drive mechanism 21 and the limit switches 25 at the terminal and start ends of the bed base arrangement 11, in the longitudinal direction, are actuated to cause repeated reciprocal travel of the massage unit 23, so resulting in performance of an agreeable massage in which the rotatable roller 241 of the rolling members 24 uniformly contact and slide over the whole of the user's back surface.

Since as described above the bed-type massage device of the invention has a construction in which an adjustable bed base arrangement, which can be lengthened or shortened in the opposed lengthwise directions due to one end of a second base being fitted into an opening on one end of a first base, has provided therein a drive mechanism and a massage unit which respond to lengthening and shortening in the said opposed directions, the whole of the upper surface of the bed base arrangement is covered by a covering cloth which responds to lengthening and shortening in opposed directions, lengthening and shortening of the bed base and covering cloth are always effected in conjunction and the massage unit is not actuated when the bed base has been contracted but travels repeatedly and smoothly over the whole lengthwise area of the bed base arrangement when the bed base arrangement has been lengthened or shortened and fine adjustments have been made. In addition, the bed base arrangement length and volume can be approximately halved at times of transport and delivery or during storage since the second base can be accommodated inside the first base and it is therefore possible to greatly reduce transport costs and packing costs, in addition to which the external packaging of the device when it is reduced to half its size can be made attractive.

Further, since a plurality of retention holes are provided at set intervals on the left and right sides of the lower surface of the second base and there is provided lock pins for engagement in these holes, it is possible to make fine adjustments of the bed base length in correspondence to the height of the user, and the device is therefore employable as a special-purpose bed or a special-purpose massage bed. In particular, when it is used as a special-purpose massage bed, there is a reduction of waste in relation to power and there is also less waste of time since the massage unit does not move over an unnecessary range going beyond the body length.

Further, since the massage unit is always held in a stable state by a pair of rod-like screwshafts on opposite sides of the base, the back area of a user lying face upwards is not subjected to discomfort such as caused with drive mechanisms such as in the past which have a rod-like screwshaft in the center and guide rods provided on two sides for supporting the massage unit. There is also the advantage that this drive mechanism reduces production costs.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A bed-type massaging device comprising an adjustable bed base arrangement which is extendible and contractible in opposed lengthwise directions and includes a flat first base and a flat second base which slides into said flat first base, each of said bases having left and right side portions; lock mechanisms coacting between said first and second bases for fixing them together and defining a selected one of a plurality of possible lengths of said bed base arrangement; a pair of guide rails formed on an upper surface of said first base so as to extend longitudinally therealong on said left and right side portions thereof; a drive mechanism including a pair of synchronously rotated rod-like screwshafts positioned to extend in the longitudinal direction along said side portions of said second base; a massage unit which extends transversely between and is in screw engagement with said rod-like screwshafts for permitting longitudinal movement of said massage unit to a plurality of positions along said screwshafts, said massage unit projecting lengthwise substantially beyond said screwshafts and being movably supported on said guide rails when in one of said positions; limit switch means provided on said bed base arrangement for causing cyclic back-and-forth travel of said massage unit longitudinally of said bed base arrangement; and a covering cloth which is wound around to cover the entire upper surface of said bed base arrangement.

2. In a massaging-type bed provided with a bed base, and a flexible sheet-like cover positioned so as to extend over an upper surface of the bed base, the improvement comprising:

said bed base including first and second generally U-shaped bed base members each including a bight part having opposite ends, and a pair of substantially hollow leg parts which project generally perpendicularly from said opposite ends of the respective bight part in generally parallel relationship to one another, the leg parts of said bed base members being slidably telescoped with each other to permit the lengthwise dimension of the bed base to be selectively extended or contracted;

locking means coacting between said first and second bed base members for permitting the bed base members to be selectively fixedly locked together in a selected one of a plurality of lengthwise positions to permit selective expansion or contraction in the length of the bed base;

a massaging unit extending transversely between the leg parts below said cover and being movably supported on said bed base for movement in the lengthwise direction thereof;

drive means mounted on said bed base and interconnected to said massaging unit for effecting linear movement of said massaging unit in the lengthwise direction of the bed base, said drive means including a pair of synchronously rotatable rod-like driving screwshafts disposed in generally parallel relationship, said screwshafts extending generally in the lengthwise direction of the bed base and positioned generally in the interior of the hollow leg parts of one of said base members, said massaging unit extending transversely between said last-mentioned leg parts and including opposite sides which have coupling means provided thereon and maintained in driving engagement with said screwshafts for permitting lengthwise movement of said massaging unit to a plurality of positions along said screwshafts, and said massaging unit projecting lengthwise from said coupling means substantially beyond said screwshafts when in one of said positions; and limit switch means cooperating with said massaging unit and said drive means for effecting cyclic back-and-forth movement of the massaging unit relative to the bed base in the lengthwise direction thereof, said limit switch means including first and second limit switches which are respectively mounted on said first and second bed base members for defining the positional limits of travel of the massaging unit.

3. A massaging-type bed according to claim 2, wherein the leg parts of said first and second base members define thereon upwardly-facing guide surfaces which extend longitudinally along the leg parts in the lengthwise direction of the bed base, and said massaging unit having guide rollers mounted on said opposite sides thereof and disposed in rolling engagement with said guide surfaces.

4. A massaging-type bed according to claim 3, wherein said massaging unit includes a generally rectangular ring-like frame defined by a pair of sidewardly-spaced support rails and a pair of generally parallel transverse support shafts, said support rails being disposed adjacent the leg parts of the bed base and rigidly joining said transverse support shafts together, said transverse support shafts being spaced a significant distance apart in the lengthwise direction of the bed base, said transverse support shafts including opposite ends and having said guide rollers mounted adjacent said opposite ends thereof for rolling engagement with the guide surfaces, and said massaging unit including a massage roller unit supported on each of said transverse support shafts and positioned for engaging an underside of the cloth when a person lies on said cloth.

5. A massaging-type bed according to claim 2, wherein the leg parts of said second base member slidably telescope generally into the leg parts of said first base member, said screwshafts being mounted on and extending generally along the interior of the leg parts of said second base member, said drive means also including drive motor means mounted on said second base member in the vicinity of the bight part thereof.

6. A massaging-type bed according to claim 2, wherein said leg parts of the other said base member include means defining upwardly facing guide surfaces thereon, said guide surfaces extending from said bight part of said other base member along said leg parts thereof and having a length which is approximately equal to a length of said leg parts thereof, said screwshafts extending from said bight part of said one base member along said leg parts thereof and having a length which is approximately equal to a length of said leg parts thereof, and said massaging unit including an end portion which has guide rollers mounted thereon and which, when said massaging unit is in said one position, projects lengthwise substantially beyond said screwshafts with said guide rollers disposed in rolling engagement against said guide surfaces of said other base member.

7. A massaging-type bed according to claim 6, wherein said massaging unit includes a massage roller unit supported thereon adjacent said end portion thereon, said massage roller unit also projecting lengthwise substantially beyond said screwshafts when said massaging unit is in said one position.

* * * * *